US005809926A

United States Patent [19]

Kelsey

[11] Patent Number: 5,809,926

[45] Date of Patent: Sep. 22, 1998

[54] LIFTING FIN

[76] Inventor: Kevin Kelsey, 11538 Riviera PI NE, Seattle, Wash. 98125-5921

[21] Appl. No.: 501,414

[22] Filed: Jul. 12, 1995

[51] Int. Cl.[6] ..... B63B 1/24

[52] U.S. Cl. ..... 114/274; 114/280; 114/39.2; 441/79

[58] Field of Search ..... 114/274, 280, 114/39.2; 441/74, 75, 79

[56] References Cited

U.S. PATENT DOCUMENTS

| | | | |
|---|---|---|---|
| 3,459,146 | 8/1969 | Prior | 114/66.5 |
| 3,747,138 | 7/1973 | Morgan | 9/310 E |
| 4,320,546 | 3/1982 | Knox | 441/74 |
| 4,508,046 | 4/1985 | Coulter et al. | 114/39 |
| 4,686,922 | 8/1987 | Burroughs | 114/124 |
| 4,715,304 | 12/1987 | Steinberg | 114/39.2 |
| 4,811,674 | 3/1989 | Stewart | 114/39.2 |
| 5,062,378 | 11/1991 | Bateman | 114/274 |
| 5,309,859 | 5/1994 | Miller | 114/274 |

FOREIGN PATENT DOCUMENTS

| | | | |
|---|---|---|---|
| 2563177 | 10/1985 | France | 114/274 |

OTHER PUBLICATIONS

Morwood, John "Hydrofoil Craft" AYRS#19, Amatuer Yacht Research Society, Jun. 1958, pp. 24–25.

Grogono, James "Icarus, The Boat that Flies" Adlard Coles Ltd, London 1987 pp. 111–112.

"Now Your Sailboard Can Fly" Popular Mechanics Magazine, Jun. 1983, pp. 72–74.

Garrett, R, "Sulu–Mosquito Trimaran Mk 11" Letter Sailing Hydrofoils AYRS #74 Hermitage–Berks, 1970, pp. 197–202 in book by Amatuer Yact Research Society Members.

*Primary Examiner*—Jesus D. Sotelo

[57] ABSTRACT

A sloped hydrofoil (22) is mounted to the bottom of a sailboard or surfboard vertical strut (26) using a hinge joint (24). Hinge joint (24) allows reversal of sloped hydrofoil (22) slope in response to a hull (30) side slip. Efficient sloped hydrofoil (22) supports a portion of craft weight to reduce hull (30) drag.

17 Claims, 11 Drawing Sheets

LIFTING FIN

BACKGROUND-FIELD OF INVENTION

This invention relates to sailboats, to sailboards, to surfboards, and to hydrofoil arrangements which can be used to improve the efficiency and speed.

BACKGROUND-DESCRIPTION OF PRIOR ART

Nearly all prior art for hydrofoil equipped sailboats, sailboards and surfboards have sought to raise the hull from the water. This approach suffers a number of disadvantages:

(a) Close proximity of the hydrofoil to the waters surface and piercing of the waters surface increases the occurrence of ventilation.

(b) Close proximity of the hydrofoil to the waters surface increases the occurrence of the foil broaching the surface in waves which may cause instability.

(c) Close proximity of the hydrofoil to the waters surface reduces the efficiency of the hydrofoil.

(d) The number of hydrofoil elements required for pitch and roll stability once the hull is removed from the water increases the complexity of the design.

(e) The number of hydrofoil elements required for stability increases the weight of the design.

(f) The number of hydrofoil elements required for stability make retrofit of a existing hull more complex.

U.S. Pat. 4,811,674 to Stewart (1989) utilized hydrofoils to provide lift without raising a sailboard hull from the water. The hydrofoil elements were attached to the rail of the hull and were vulnerable to ventilation and low efficiency due to surface proximity. The hydrofoils required custom attachment points on the hull or used two thruster finbox present only on a specialized wave riding sailboard hull or specialized surfboard.

OBJECTS AND ADVANTAGES

Several objects of the lifting fin are:

(a) simplicity of hydrofoil configuration by using only a single unit;

(b) allow quick and easy mounting and detachment of hydrofoils by having only one attachment point;

(c) allow retrofit to standard sailboard and surfboard hulls by using the finbox as the attachment point;

(d) reduce ventilation of the hydrofoil by deep submergence;

(e) give excellent rough water stability by using an immersed hull;

(f) maximize hydrofoil efficiency by deep submergence;

(g) minimize interference drag by separation of hull and hydrofoil;

(h) provide automatic lift control to avoid hydrofoil broaching by use of sloped hydrofoil;

(i) reduce hull drag by reducing hull planing lift.

Taken together, the above objects lead to the prime object to increase sailboard and surfboard speed.

Still further objects and advantages will become apparent from a consideration of the ensuing description and drawings.

DRAWING FIGURES

| | |
|---|---|
| 20 | lifting fin |
| 22 | sloped hydrofoil |
| 24 | hinge joint |
| 26 | vertical strut |
| 28 | standard fin box |
| 30 | standard slalom style sailboard or surfboard hull |
| 32 | hinge bulb on sloped hydrofoil |
| 34 | hinge bulb on vertical strut |
| 36 | hinge pin |
| 40 | cross pin |
| 42 | bolt |
| 44 | cross piece slider |
| 46 | hinge stop |
| 48 | finbox hinge piece |
| 50 | standard sailboard retracting centerboard |
| 60 | foot strap |
| 62 | foot strap extension platform |
| 64 | standard foot strap attachment screws |
| 66 | platform foot strap |
| 68 | fiberglass cloth |
| 70 | lifting fin daggerboard |
| 72 | conventional dinghy hull |
| 74 | daggerboard trunk |
| 76 | hold-down line |

DESCRIPTION-FIGS. 1 TO 12

Figure 1A:
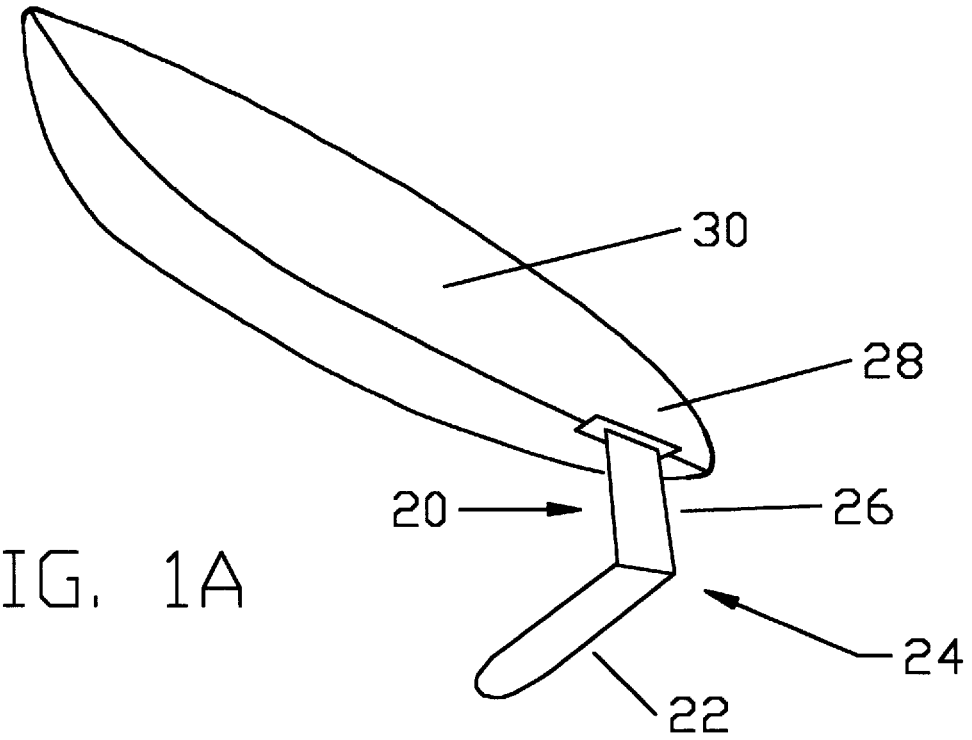
FIG. 1A shows a perspective view of the bottom of a sailboard or surfboard hull with a lifting fin.
Figure 1B:
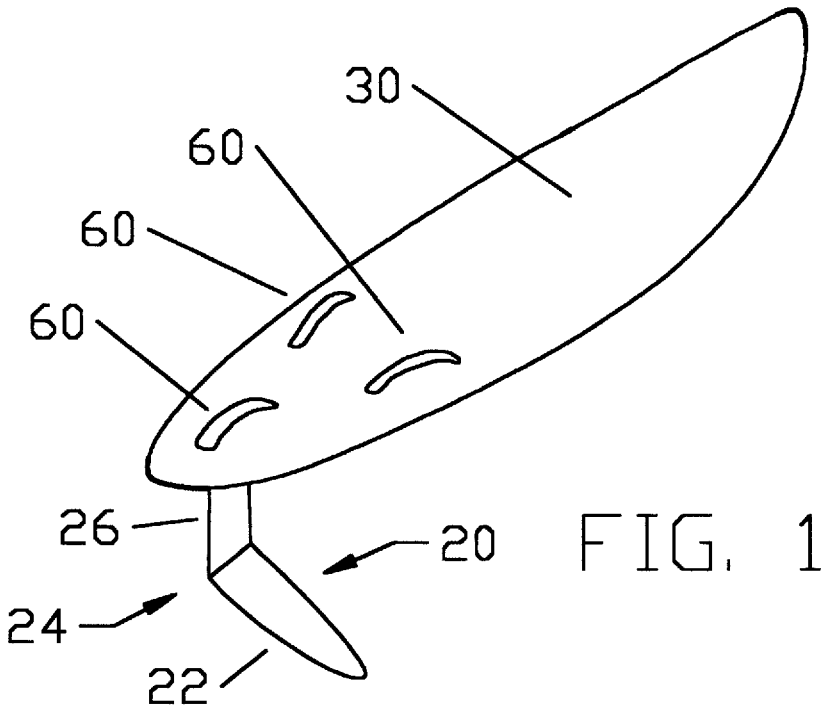
FIG. 1B shows a perspective view of the top of a sailboard or surfboard hull with a lifting fin.

In FIGS. 1A and 1B, a standard slalom style sailboard or surfboard hull 30 has a standard finbox 28 and a trio of foot strap 60. A lifting fin 20 has a vertical strut 26 which is inserted into finbox 28. A hinge joint 24 connects vertical strut 26 to a sloped hydrofoil 22.

Figure 2:
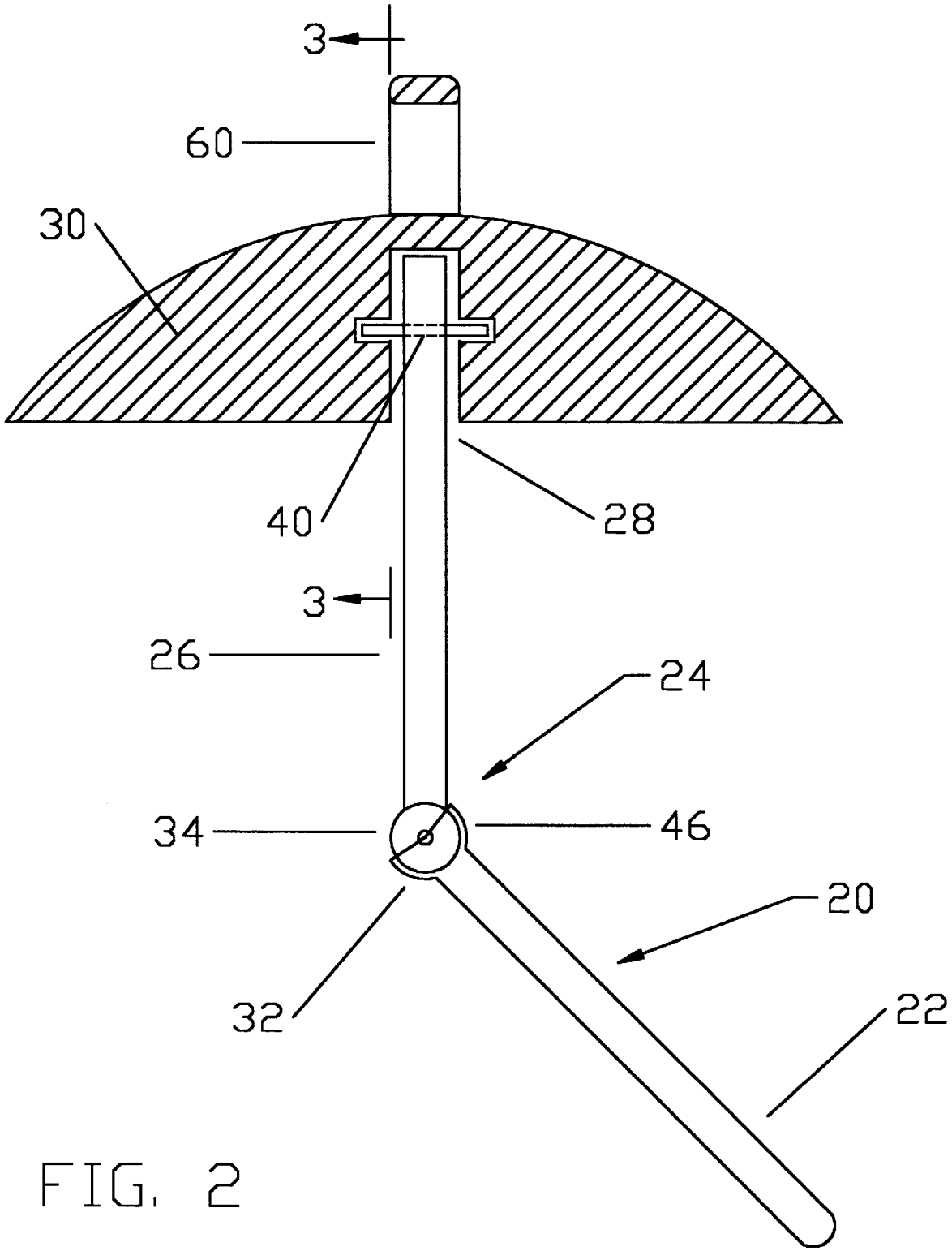
FIG. 2 shows an end view of a sailboard or surfboard hull with a lifting fin.
Figure 3:
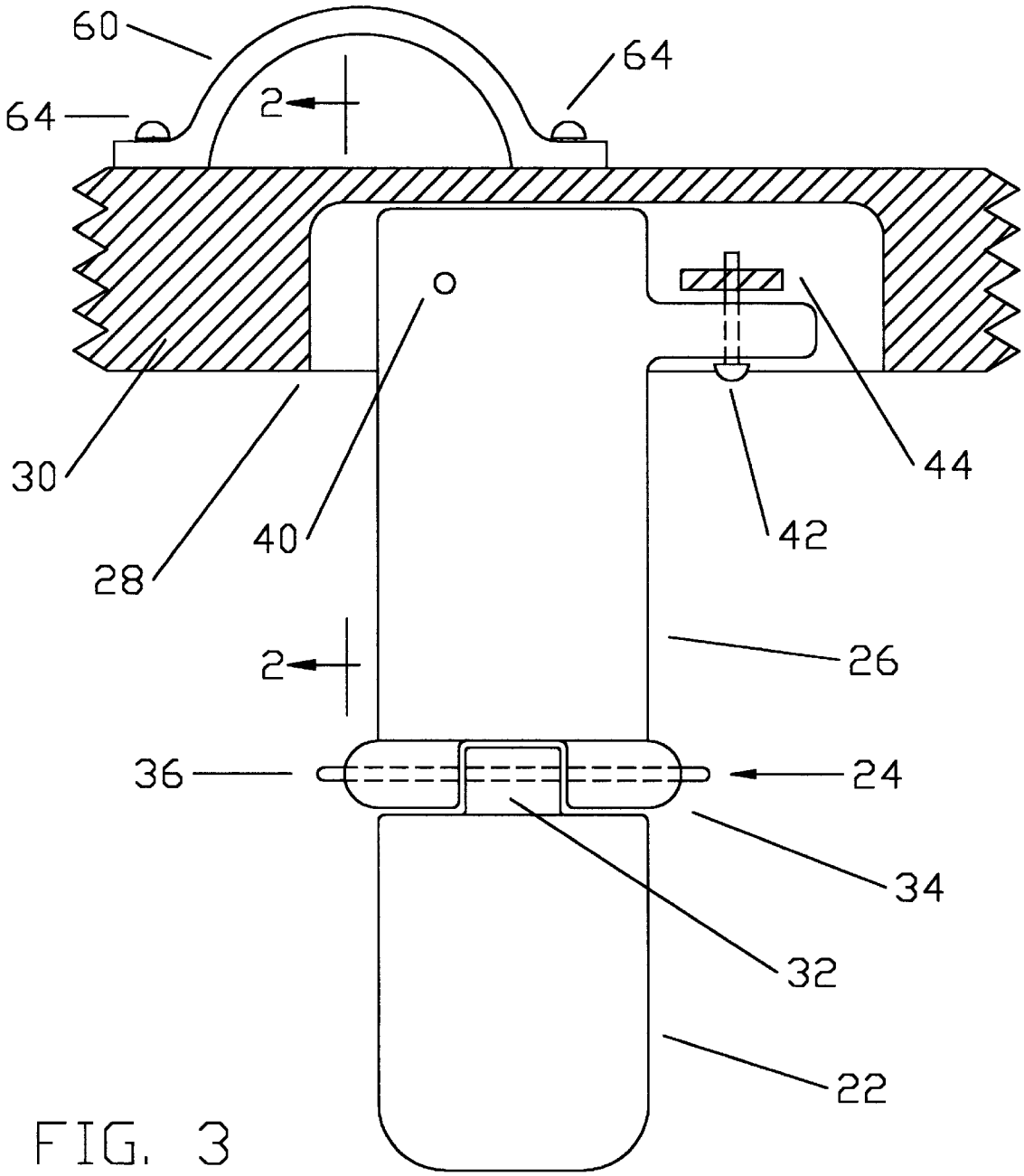
FIG. 3 shows a side view of a sailboard or surfboard hull with a lifting fin.

FIGS. 2 and 3 show end and side view of hull 30 and lifting fin 20. A hinge bulb 32 on sloped hydrofoil 22 and a hinge bulb 34 on vertical strut 26 are connected by a hinge pin 36. Vertical strut 26 is attached to finbox 28 using the common methods with a crosspin 40, a bolt 42, and a cross piece slider 44. Sloped hydrofoil 22 is free to hinge side-to-side relative to vertical strut 26. Hinge bulb 32 and 34 can be cast or molded as part of vertical strut 26 and sloped hydrofoil 22. A hole is drilled through hinge bulb 32 and 34 for hinge pin 36. The swing of hinge joint 24 is limited by the contact on the inside edges of vertical strut 26 and a hinge stop 46 projecting from hinge bulb 32. Hinge stop 46 can be cast or molded as part of hinge bulb 32. Rear foot strap 60 is connected to hull 30 by a pair of standard foot strap attachment screws 64.

Figure 4:
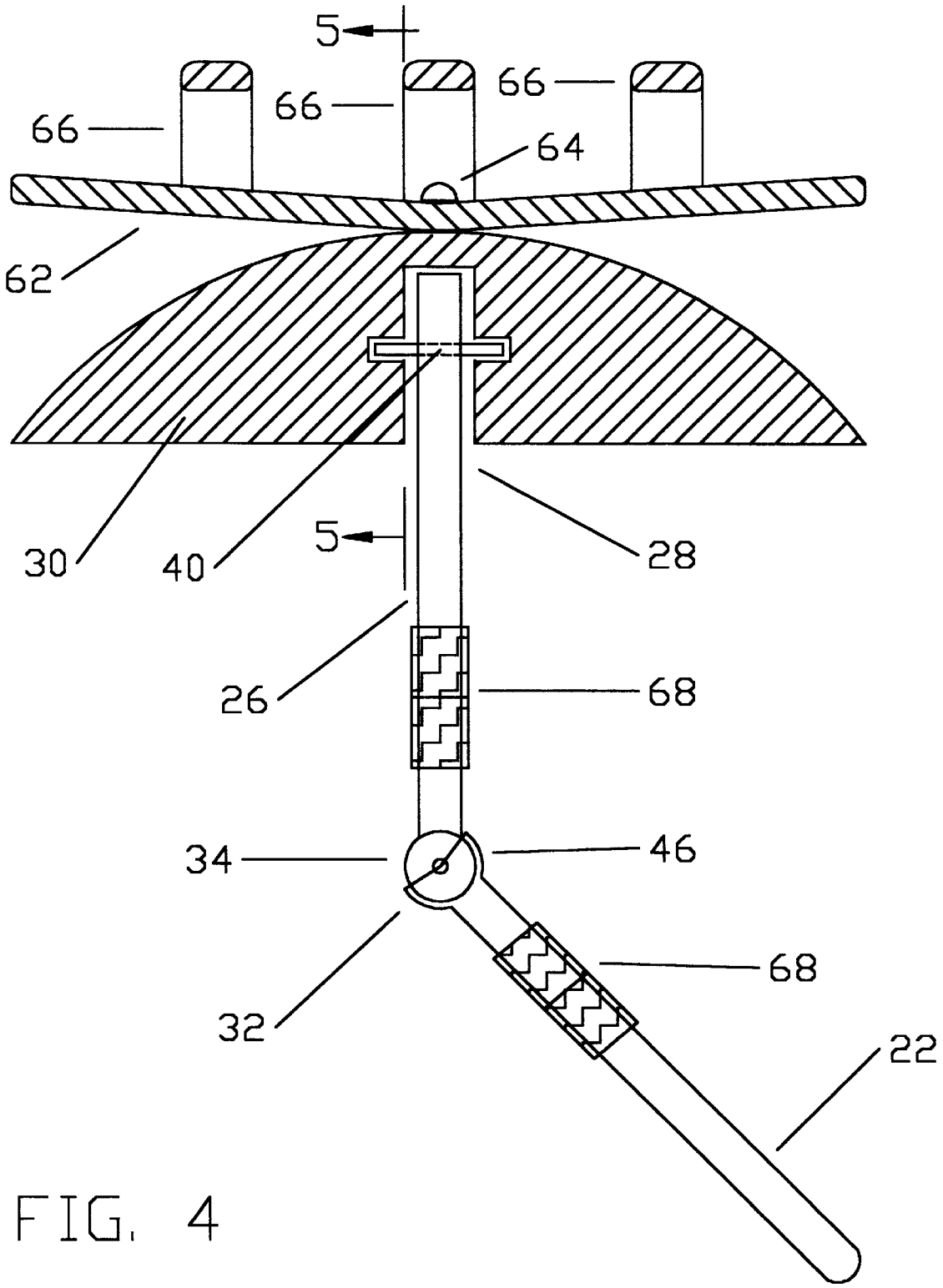
FIG. 4 shows an end view of a sailboard or surfboard hull with an alternate embodiment of the lifting fin.
Figure 5:
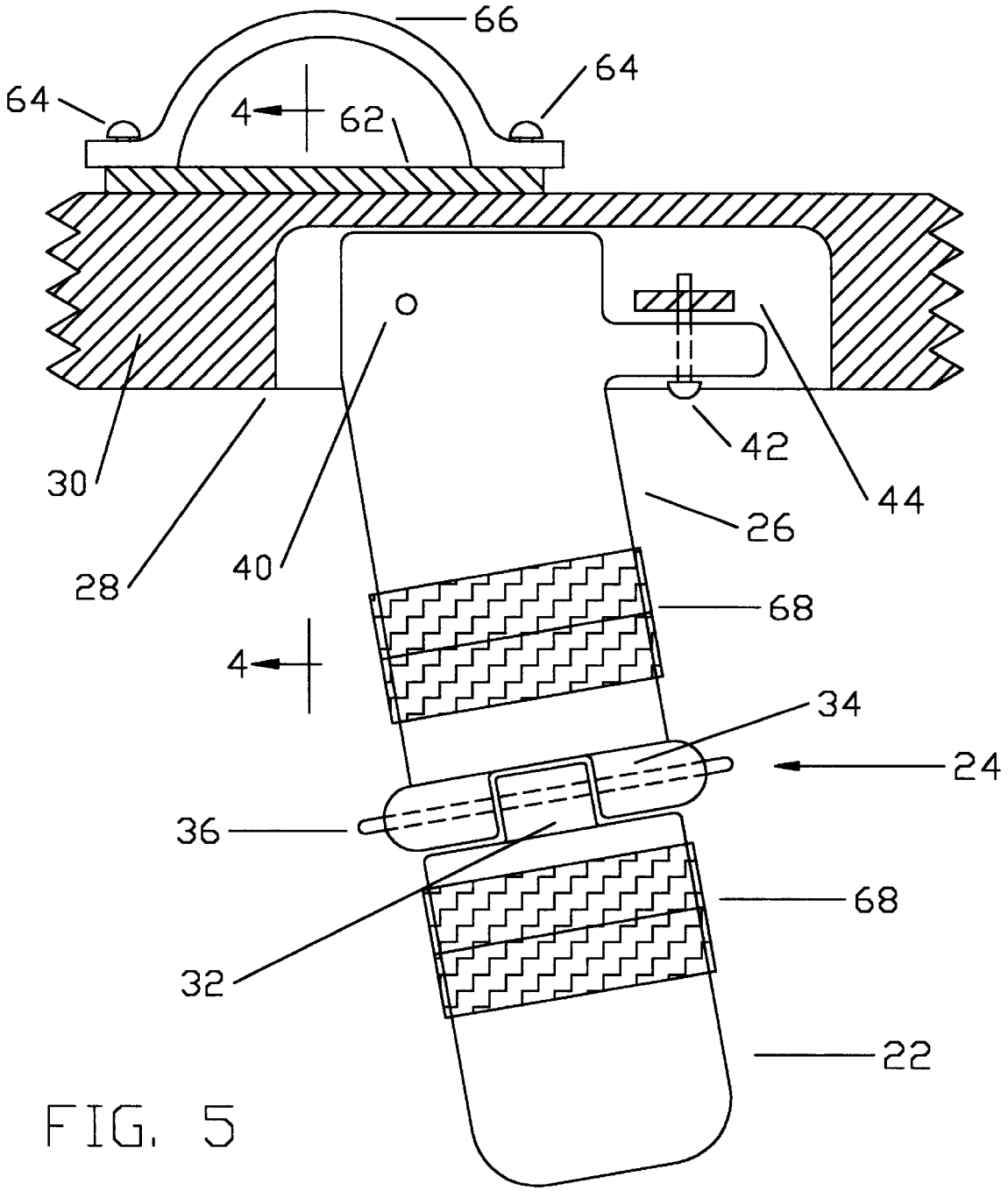
FIG. 5 shows a side view of a sailboard or surfboard hull with an alternate embodiment of the lifting fin.

FIGS. 4 and 5 show end and side view of hull 30 and an alternate embodiment of lifting fin 20 to allow fiberglasss construction. Vertical strut 26 and sloped hydrofoil 22 are constructed of fiberglass to reduce weight. Hinge bulb 32 and 34 and short lengths of hydrofoil are cast or molded of metal to withstand the high stress in hinge joint 24. Hinge bulb 32 is joined to vertical strut 26 by several layers of fiberglass cloth 68 wrapped around the outside of vertical strut 26 and the short length of hydrofoil that is part of hinge bulb 32. Epoxy resin is used to ensure a good bond to the metal. Hinge bulb 34 is joined to sloped hydrofoil 22 by the same method.

FIG. 5 also shows vertical strut 26 and sloped hydrofoil 22 with a sweep forward angle. This sweep angle increases the angle of attack of sloped hydrofoil 22 while not changing the angle of attack of vertical strut 26.

FIGS. 4 and 5 also show end and side views of hull 30 and an additional element in place of rear foot strap 60. A foot strap extension platform 62 is mounted to hull 30 using two standard foot strap screws 64 which normally attach rear foot strap 60. Platform 62 is angled up out of the water and has three foot strap 66 on its upper surface.

Figure 6:
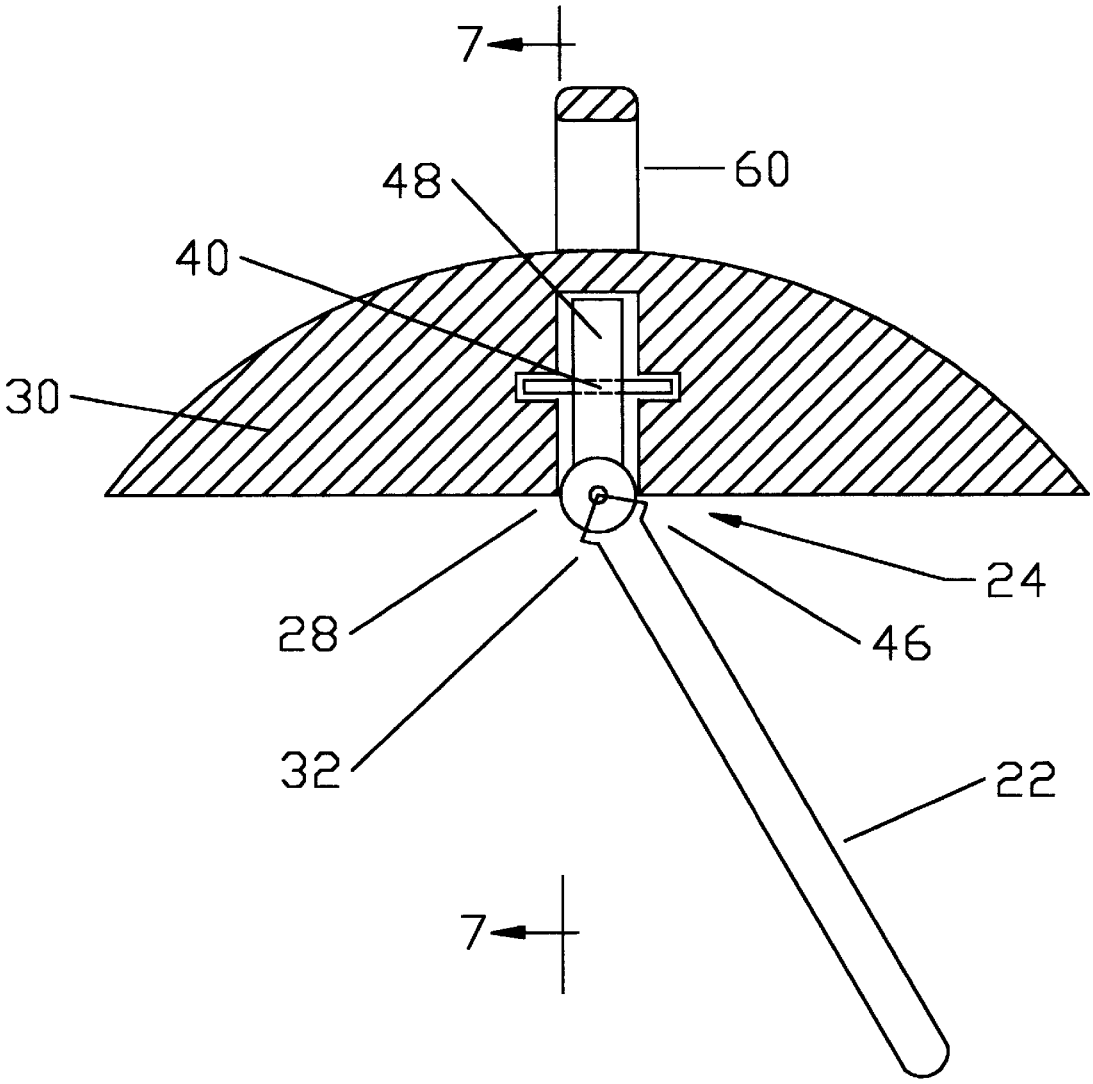
FIG. 6 shows an end view of a sailboard or surfboard hull with an alternate embodiment of the lifting fin without a vertical strut.
Figure 7:
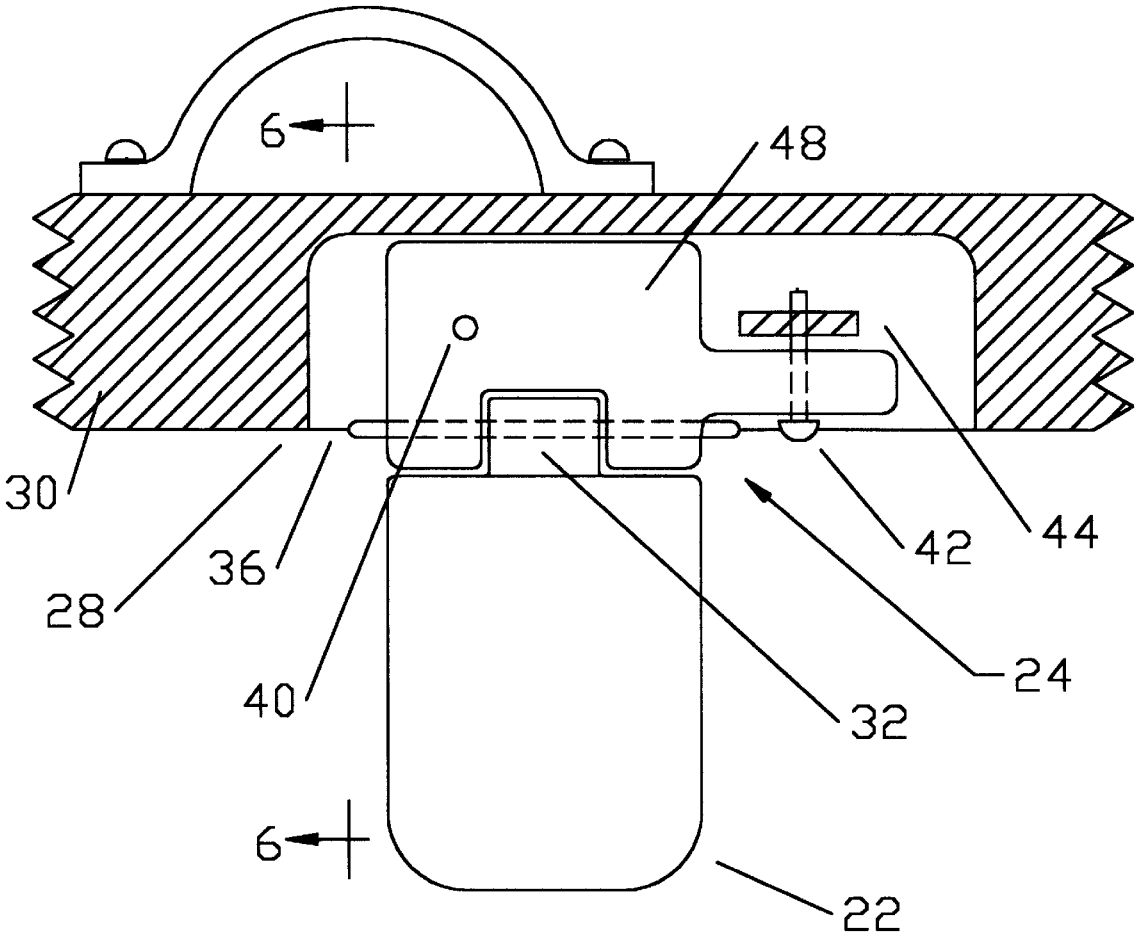
FIG. 7 shows a side view of a sailboard or surfboard hull with an alternate embodiment of the lifting fin without a vertical strut.

FIGS. 6 and 7 shows end and side view of hull 30 and an alternate embodiment of hinge joint 24. Hinge joint 24 is located at finbox 28 and vertical strut 26 is eliminated. A finbox hinge piece 48 is connected to finbox 28 in the usual manner instead of vertical strut 26. Hinge stop 46 now hits against the bottom of finbox 28.

Figure 8:
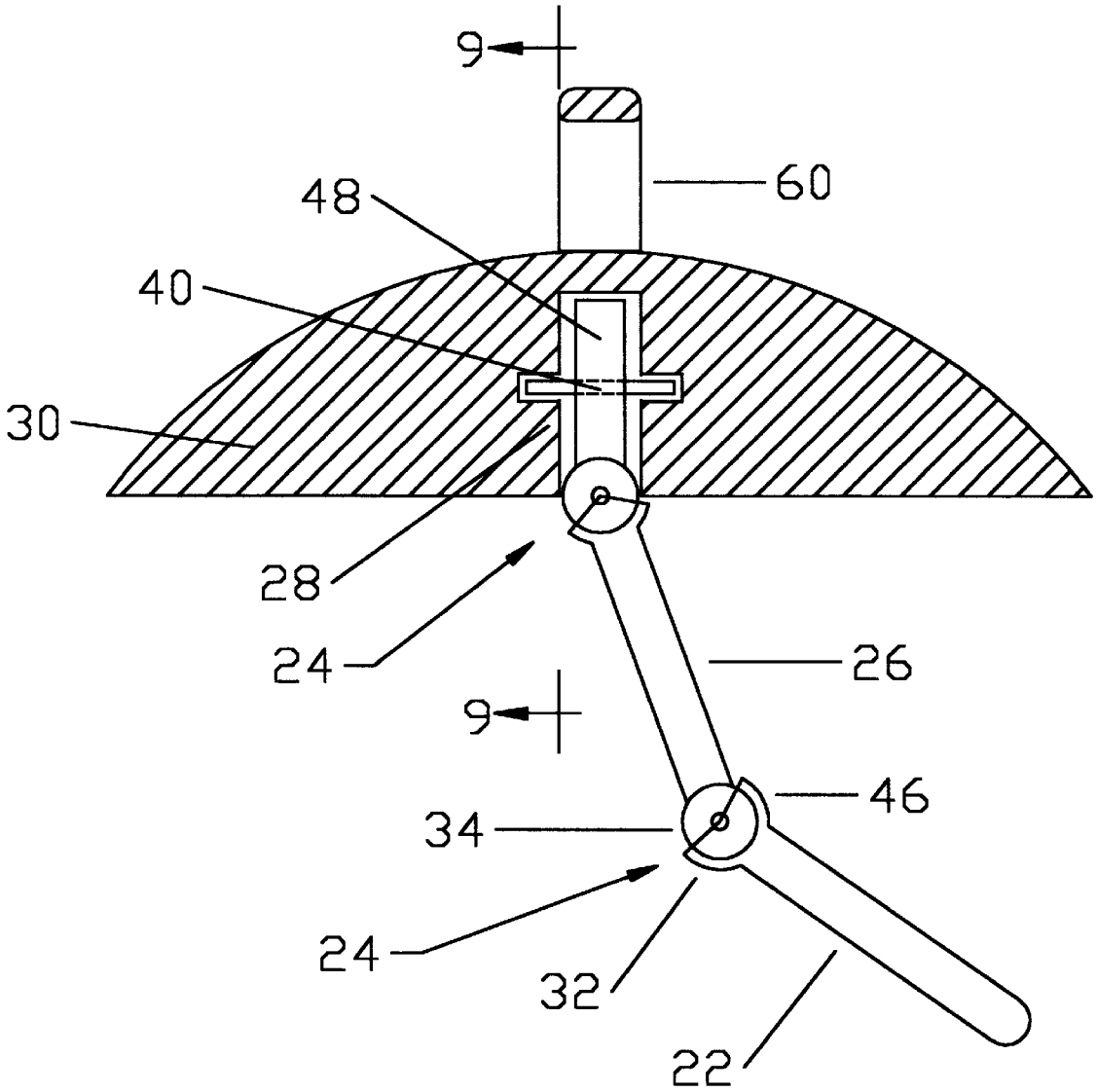
FIG. 8 shows an end view of a sailboard or surfboard hull with an alternate embodiment of the lifting fin with two hinge joint .
Figure 9:
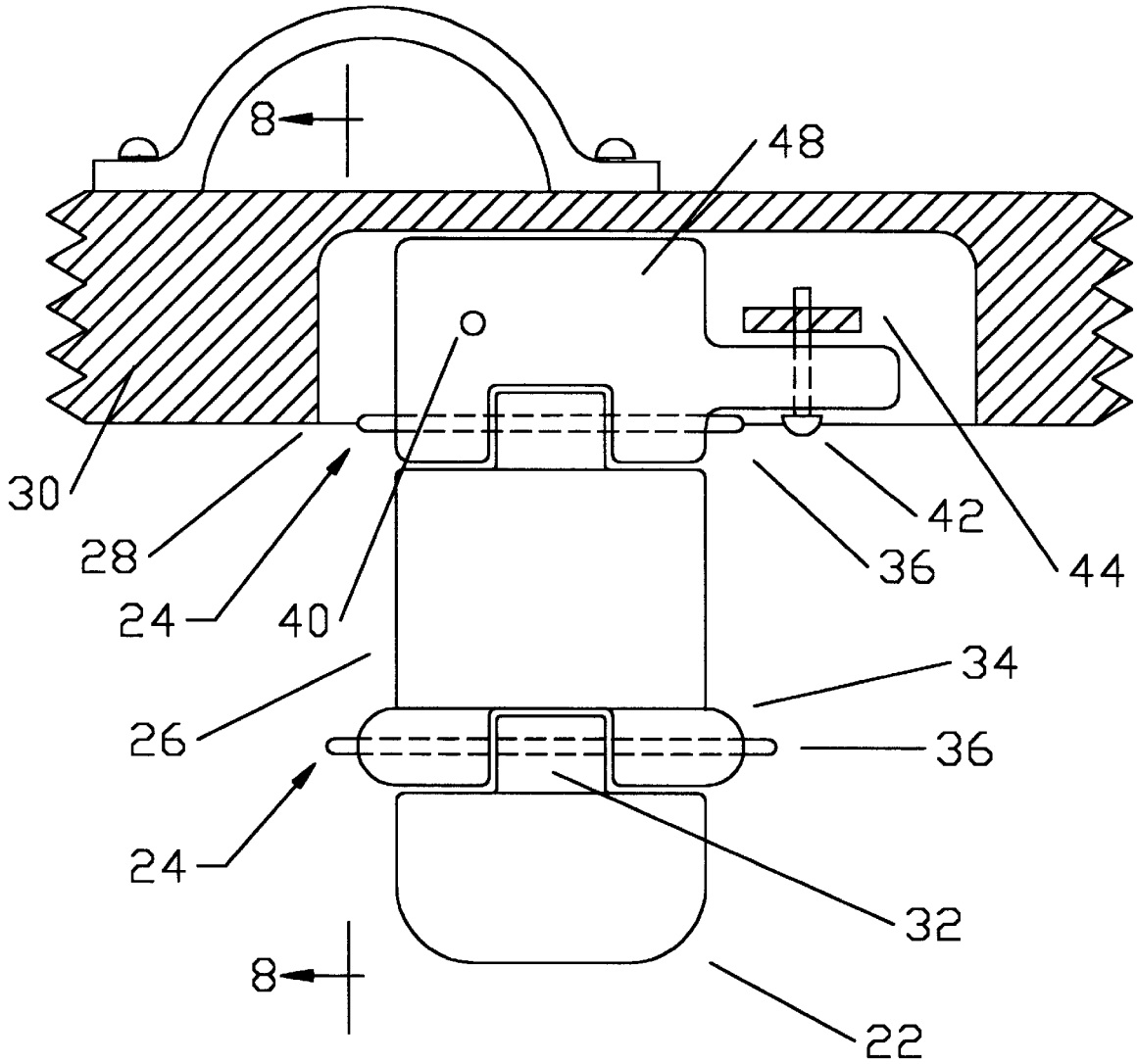
FIG. 9 shows a side view of a sailboard or surfboard hull with an alternate embodiment of the lifting fin with two hinge joint.

FIGS. 8 and 9 show end and side view of hull 30 and an alternate embodiment with two hinge joint 24. A second hinge joint 24 at finbox 28 is added to the top of vertical strut 26.

Figure 10:
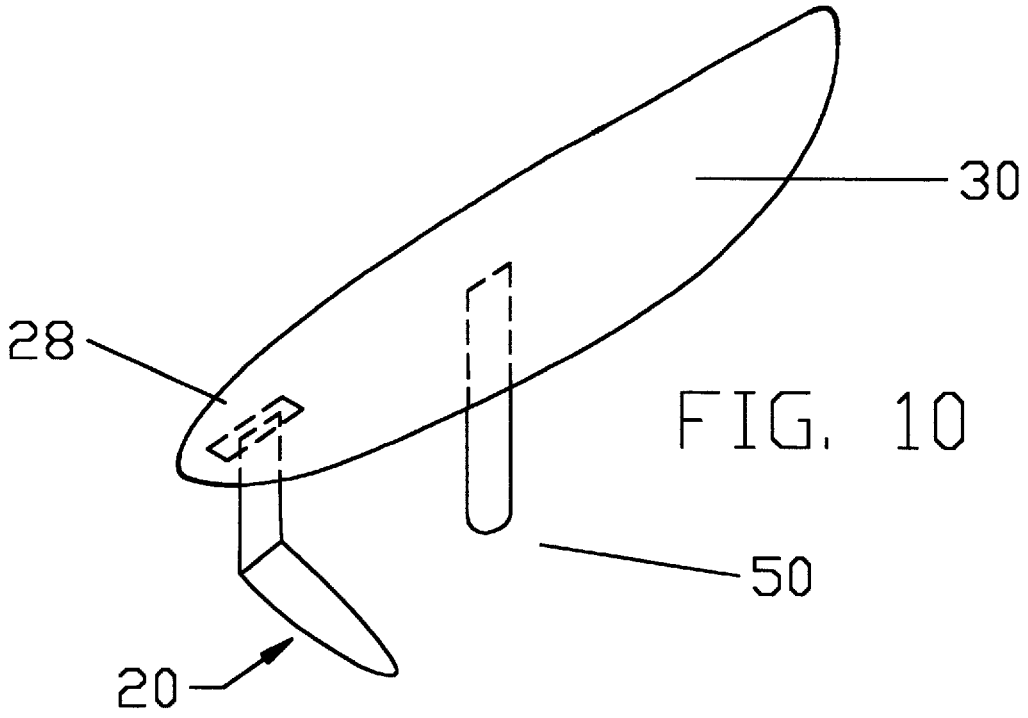
FIG. 10 shows a perspective view of a sailboard hull with a lifting fin and a standard retracting centerboard.

In FIG. 10, hull 30 has finbox 28 and lifting fin 20 and a standard sailboard retracting centerboard 50. Centerboard 50 is located in the standard position on hull 30.

Figure 11:
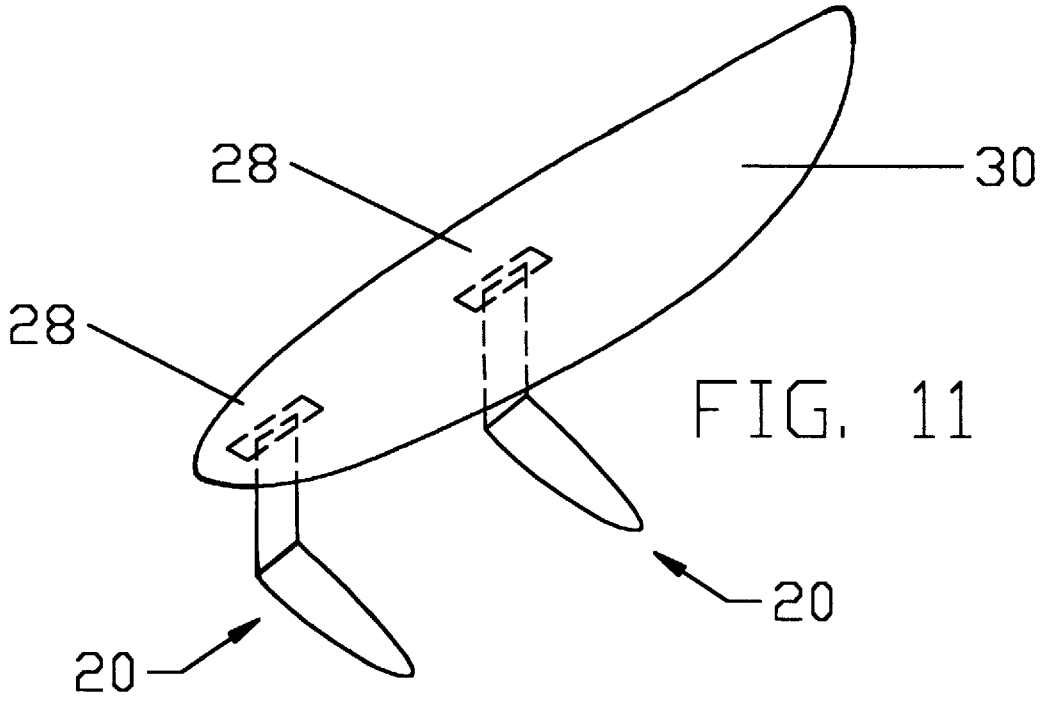
FIG. 11 shows a perspective view of a sailboard hull with two lifting fin spaced fore and aft.

In FIG. 11, hull 30 has two finbox 28 and two lifting fin 20 mounted fore and aft on hull 30 centerline.

Figure 12:
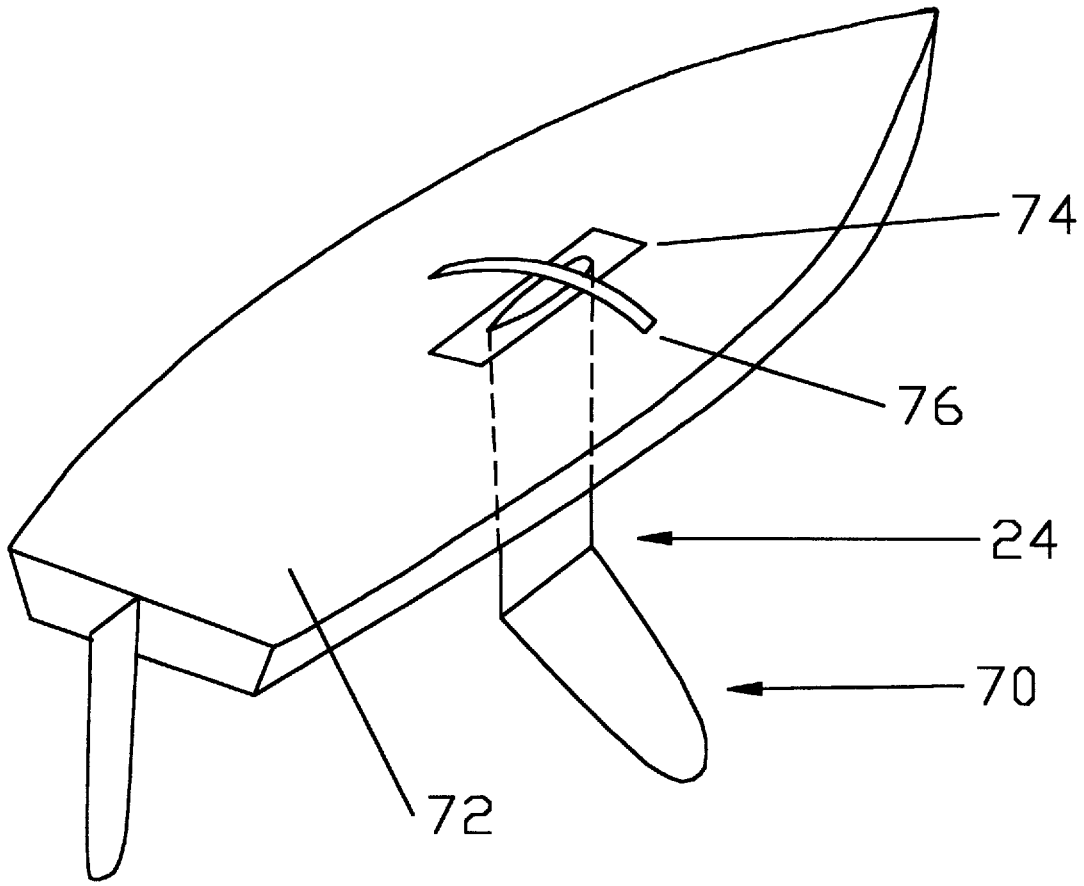
FIG. 12 shows a perspective view of a standard dinghy hull with a lifting fin daggerboard.

FIG. 12 shows an alternate embodiment with a lifting fin daggerboard 70 retrofit to a conventional dinghy hull 72. Hinge joint 24 can be made small enough, with the much larger size of a daggerboard, to be retracted up through a daggerboard trunk 74 in dinghy hull 72. A hold-down line 76 is used to hold lifting fin daggerboard 70 from rising in daggerboard trunk 74.

OPERATIONS-FIGS 1 TO 12

FIGS. 1A and 1B shows slalom style sailboard or conventional surfboard hull 30 with one lifting fin 20 providing all directional stability and side force generation. The sideslip of hull 30 when propelled by a sail (not shown), or sliding down a wave, causes hinge joint 24 to swing to windward, or upward to the crest of the wave. Vertical strut 26 then generates sideforce and sloped hydrofoil 22 then generates both sideforce and upward lift.

When the sailboarder tacks or jibes, the new sideslip direction swings hinge joint 24 to the opposite side. When the surfboarder cuts back to reverse direction, the new sideslip direction also swings hinge joint 24 to the opposite side.

FIGS. 2 and 3 show hinge stop 46 which limits the swing of hinge joint 24. In practice, an angle from vertical of 45 degrees has given best performance. The angle of attack of sloped hydrofoil 22 is set by a combination of hull side slip and hull pitch trim. Thus the angle of attack is less dependent upon either sideslip or hull trim and reduces the occurrence of stalling from excessive hull pitch trim.

The upward lift generated by lifting fin 20 is far aft. Upward lift is also far aft when the crew uses the sailing method called riding the fin which is used in strong winds to increase performance. When riding the fin, the standard fin and the tail of hull 30 are the only contact with the water. The crew maintains control when the upward lift is far aft. Sailboard and surfboard riders will move further aft without sinking the tail or hull 30.

In FIGS. 3 and 4, foot strap extension platform 62 can be used for the rear crew foot to give the crew leverage to prevent hull capsize. The increased span of lifting fin 20 increases the hull capsize moment that rolls hull 30 to lee when sailing or surfing at high speed. The crew weight to windward on platform 62 creates a moment to counter the capsize moment of lifting fin 20.

FIG. 5 shows the use of sweep forward angle to increase the angle of attack of sloped hydrofoil 22. The increased angle of attack makes sloped hydrofoil 22 generate a larger portion of the side force and increases the vertical force generated. The angle of attack of sloped hydrofoil 22 can be set so sloped hydrofoil 22 can generate nearly all the side force, with the lift of vertical strut 26 near zero, and the vertical lift generated by sloped hydrofoil 22 is maximized. Vertical strut 26 still provides directional stability in this situation.

FIGS. 6 and 7 show an alternate embodiment of lifting fin 20 with vertical strut 26 replaced by finbox hinge piece 48. Due to the close proximity of hull 30 and sloped hydrofoil 22, small slope angles are used to reduce interference drag. The design gives some vertical lift, a normal hull capsize moment, and less fin area. The design is specialized for higher wind speed when added vertical lift isn't necessary to encourage planing of hull 30.

FIGS. 8 and 9 shows an alternate embodiment of lifting fin 20 with two hinge joint 24. This allows both vertical strut 26 and sloped hydrofoil 22 to generate vertical lift.

FIG. 10 adds centerboard 50 to increase side slip resistance in light winds. This improves windward performance in light wind and centerboard 50 can be retracted in strong wind when no longer required.

FIG. 11 shows an alternate embodiment with two lifting fin 20 mounted on hull 30. Forward finbox 28 is mounted at the standard location of centerboard 50. The forward lifting fin 20 gives upward lift and sideslip resistance instead of just the sideslip resistance of centerboard 50 to reduce light wind planing speed. This configuration allows use of two smaller lifting fin 20 rather than a very large area lifting fin 20 for light wind planing.

Generally, sloped hydrofoil 22 is equal in size and area as vertical strut 26. Using sloped hydrofoil 22 much larger than vertical strut 26 greatly reduces directional stability.

Generally, the best lifting fin 20 size for a given sailing or surfing condition has vertical strut 26 area equal to that of the standard fin that would be used for the conditions.

SUMMARY, RAMIFICATIONS, AND SCOPE

Lifting fin 20 design in FIGS. 1A and 1B is very simple and practical. Using the stability of immersed hull 30, the hydrofoil configuration can be reduced to a single element rather than require multiple elements.

Lifting fin 20 is quick and easy to mount and detach as it is small in size and it is a single unit. It is no more inconvenient to mount than the standard fin (not shown) it replaces. Quick mounting allows interchange of hydrofoil sizes or use of a standard fin (not shown) to suit the changing sailing or surfing conditions for maximum performance.

Lifting fin 20 completely retrofits to standard sailboard and surfboard hulls 30 using finbox 28 present on all hulls. This allows all sailboarders and surfboarders to inexpensively take advantage of hydrofoil performance increase using their existing hull 30.

Lifting fin 20 reduces ventilation by deep submergence of sloped hydrofoil 22 by its attachment to the bottom of vertical strut 26. Ventilation of vertical strut 26 is reduced as it is not surface piercing as it is mounted to the bottom of hull 30 which remains immersed in the water. In practice, when ventilation of vertical strut 26 does occur, the ensuing spin-out is less severe and easier to recover from. Hull 30 is easier to turn downwind, or towards the bottom of the wave being surfed, for spin out recovery as the deeply submerged sloped hydrofoil 22 retains some lift that maintains some directional stability of hull 30.

Lifting fin 20 gives excellent rough water stability by taking advantage of hull 30 excellent rough water stability.

Lifting fin 20 maximizes hydrofoil efficiency by deep submergence of sloped hydrofoil 22 by its attachment to the bottom of vertical strut 26. Also, sloped hydrofoil 22 adds span length to vertical strut 26 to increase the aspect ratio and thus the lift to drag ratio.

Lifting fin 20 minimizes interference drag by using only one hull attachment point; finbox 28. Also, vertical strut 26 attaches to hull 30 at right angles for lower interference drag. In addition, sloped hydrofoil 22 is spaced away from hull 30 by vertical strut 26 to minimize the interference drag between hull 30 and sloped hydrofoil 22.

Lifting fin 20 gives automatic lift control to avoid hydrofoil broaching. The slope angle of sloped hydrofoil 22 makes the upward force generated a fixed percentage of the side-force generated by sloped hydrofoil 22. As the total side-force generated by lifting fin 20 is always less than total craft weight, the upward lift of sloped hydrofoil 22 is always less than total craft weight. Thus, lifting fin 20 avoids hydrofoil broaching by not lifting hull 30 off the water.

Lifting fin 20 reduces hull 30 drag. The vertical dynamic lift of the deeply submerged sloped hydrofoil 22 has a higher lift to drag ratio than planing hull 30. Sloped hydrofoil 22 vertical lift reduces required hull 30 planing lift and thus reduces hull 30 drag.

As a result of the advantages above, sailboard and surfboard speed is increased.

The vertical lift of lifting fin 20 reduces the water speed required for planing, thus adding low speed performance to a given size of hull 30. The optimum wind speed range, or surfing wave size, for a given hull 30 design is extended by use of lifting fin 20. This makes a single hull 30 more versatile, possibly eliminating the need for a second hull 30 size to cover the lower speed range.

The lower planing speed makes it easier for the crew to pump the sail (not shown) in order to propel hull 30 onto a plane.

The use of a very large sloped hydrofoil 22 allows planing of small hull 30 in very light winds. Instead of using a larger more buoyant hull 30 in light winds, the crew maybe just as fast by using a small hull 30 and switching to lifting fin 20 with a very large sloped hydrofoil 22.

In practice, lifting fin 20 adds excellent sailboard windward performance pointing ability when planing and sub-planing. The lower speed that planing occurs with lifting fin 20 allows the crew to sail a higher course to the wind while maintaining a plane. In very light winds, lifting fin 20 greatly improves windward sailing ability when hull 30 is rolled to windward about 20 degrees to increase lifting fin 20 depth to its maximum. The improved windward ability allows the crew to more easily return to shore when the wind drops, thus making the use of a small hull 30 more practical in gusty winds.

In practice, lifting tin 20 improves control by increasing directional stability. It is much easier to prevent hull 30 from rounding up into the wind. At sub-planing speeds, the crew can remain aft on hull 30 in foot straps 60 and lean forward with the sail (not shown) to steer hull 30 out of the wind. The crew can thus be in foot strap 60 ready to sail at high speed in the next gust of wind. This increases the ease of sailing. The crew no longer needs to leave foot strap 60 and move forward on hull 30 every time hull 30 stops planing. The crew can remain in foot strap 60 without sinking the tail of hull 30 or having hull 30 turn into the wind. The crew can remain in foot strap 60 while not planing, while pumping the sail to help start planing and to remain in a position to prevent the sail from pulling the crew over the bow in the next gust of wind.

Although the description above contains many specificities, these should not be construed as limiting the scope of the invention, but as merely providing illustrations of some of the presently preferred embodiments of this invention. For example, mechanisms can be used to adjust the sweep forward angle of lifting fin 20 shown in FIG. 5 for different sailing or surfing conditions. Thus the scope of the invention should be determined by the appended claims and their legal equivalents, rather than by the examples given.

I claim:

1. A hydrofoil assembly mounted on a hull comprising:

(a) a substantially vertical hydrofoil;

(b) a single sloped hydrofoil;

(c) a hydrofoil hinging means for joining an upper end of said sloped hydrofoil to the bottom end of said vertical hydrofoil, said hinging means having a center line substantially parallel to the longitudinal axis of said hull; and (d) a hinging stop means for limiting said hydrofoil hinging means so that said sloped hydrofoil assumes a maximum angle of 90 degrees to both sides of the vertical.

2. The hydrofoil assembly mounted on a hull of claim 1 further including:

(a) a hull in contact with the water;

(b) a first hull attachment means for mounting an upper end of said vertical hydrofoil to the bottom of said hull;

(c) a second substantially vertical hydrofoil;

(d) a second single sloped hydrofoil;

(e) a second hull attachment means for mounting an upper end of said second vertical hydrofoil to the bottom of said hull at a different location than said first hull attachment means;

(f) a second hydrofoil hinging means joining an upper end of said second sloped hydrofoil to the bottom end of said second vertical hydrofoil, said second hinging means having a center line substantially parallel to the longitudinal axis of said hull; and (g) a second hinging stop means for limiting said second hydrofoil hinging means so that said second sloped hydrofoil assumes a maximum angle of 90 degrees to both sides of the vertical.

3. The hydrofoil assembly mounted on a hull of claim 1 further including:

(a) a hull in contact with the water;

(b) hull attachment means for mounting an upper end of said vertical hydrofoil to the bottom of said hull; and (c) a substantially horizontal projection from said hull , on both sides of a center line of said hull , said horizontal projection having an upper surface on which a plurality of foot straps are mounted.

4. The hydrofoil assembly mounted on a hull of claim 1 further including:

(a) a hull in contact with the water (b) hull attachment means for mounting an upper end of said vertical hydrofoil to the bottom of said hull (c) retraction means for said hull attachment means to allow said vertical hydrofoil and said sloped hydrofoil to be retracted into a recess in the bottom of said hull.

5. The hydrofoil assembly mounted on a hull of claim 1 further including:

(a) a hull in contact with the water (b) hull attachment means for mounting an upper end of said vertical hydrofoil to the bottom of said hull.

6. The hydrofoil assembly mounted on a hull of claim 1 further including:

(a) a hull in contact with the water;

(b) a first hull attachment means for mounting an upper end of said vertical hydrofoil to the bottom of said hull;

(c) a second substantially vertical hydrofoil; and (d) a second hull attachment means for mounting an upper end of said second vertical hydrofoil to the bottom of said hull at a different location than said first hull attachment means.

7. A hydrofoil assembly mounted on a hull comprising:

(a) a single sloped hydrofoil;

(b) a hydrofoil hinging means for joining an upper end of said sloped hydrofoil to the hull, said hinging means having a center line substantially parallel to the longitudinal axis of said hull; and (c) a hinging stop means for limiting said hydrofoil hinging means so that said sloped hydrofoil assumes a maximum angle of 90 degrees to both sides of the vertical.

8. The hydrofoil assembly mounted on a hull of claim 7 further including:

(a) a hull in contact with the water;

(b) a second single sloped hydrofoil;

(c) at a different location than said hinging means, a second hinging means joining an upper end of said second sloped hydrofoil to the bottom of said hull , said second hinging means having a center line substantially parallel to the longitudinal axis of said hull; and (d) a second hinging stop means for limiting said second hinging means so that said second sloped hydrofoil assumes a maximum angle of 90 degrees to both sides of the vertical.

9. The hydrofoil assembly mounted on a hull of claim 7 further including:

(a) a hull in contact with the water; and (b) a substantially horizontal projection from said hull , on both sides of a center line of said hull , said horizontal projection having an upper surface on which a plurality of foot straps are mounted.

10. The hydrofoil assembly mounted on a hull of claim 7 further including:

(a) a hull in contact with the water (b) retraction means for said hinging means to allow said sloped hydrofoil to be retracted into a recess in the bottom of said hull.

11. The hydrofoil assembly mounted on a hull of claim 7 further including a hull in contact with the water.

12. The hydrofoil assembly mounted on a hull of claim 7 further including:

(a) a hull in contact with the water (b) a substantially vertical hydrofoil (c) hull attachment means for mounting an upper end of said vertical hydrofoil to the bottom of said hull at a different location than said hinging means.

13. A hydrofoil assembly mounted on a hull comprising:

(a) a surfboard or sailboard fin;

(b) a single sloped hydrofoil;

(c) a hydrofoil hinging means for joining an upper end of said sloped hydrofoil to a bottom end of said fin, said hinging means having a center line substantially parallel to the longitudinal axis of said hull; and (d) a hinging stop means for limiting said hydrofoil hinging means so that said sloped hydrofoil assumes a maximum angle of 90 degrees to both sides of the vertical.

14. The hydrofoil assembly mounted on a hull of claim 13 further including:

(a) a surfboard or sailboard hull;

(b) a first finbox, in the bottom of said hull attaching to said fin;

(c) a second surfboard or sailboard fin;

(d) a second single sloped hydrofoil;

(e) a second finbox, in the bottom of said hull at a different location than said first finbox, attaching to said second fin;

(f) a second hydrofoil hinging means joining an upper end of said second sloped hydrofoil to a bottom end of said second fin, said second hinging means having a center line substantially parallel to the longitudinal axis of said hull; and (g) a second hinging stop means for limiting said second hydrofoil hinging means so that said second sloped hydrofoil assumes a maximum angle of 90 degrees to both sides of the vertical.

15. The hydrofoil assembly mounted on a hull of claim 13 further including:

(a) a surfboard or sailboard hull;

(b) a finbox, in the bottom of said hull attaching to said fin; and (c) a substantially horizontal projection from said hull , on both sides of a center line of said hull , said horizontal projection having an upper surface on which a plurality of foot straps are mounted.

16. The hydrofoil assembly mounted on a hull of claim 13 further including:

(a) a surfboard or sailboard hull (b) a finbox, in the bottom of said hull attaching to said fin.

17. The hydrofoil assembly mounted on a hull of claim 13 further including:

(a) a hull in contact with the water;

(b) a finbox, in the bottom of said hull attaching to said fin;

(c) a substantially vertical hydrofoil; and (d) a hull attachment means for mounting an upper end of said vertical hydrofoil to the bottom of said hull at a different location than said finbox.

* * * * *